US005958526A

United States Patent [19]

Spickelmire

[11] Patent Number: 5,958,526

[45] Date of Patent: Sep. 28, 1999

[54] ADHESIVE CAMOUFLAGE PATCH

[76] Inventor: James Spickelmire, 724 S. "C", Grangeville, Id. 83530

[21] Appl. No.: 09/079,319

[22] Filed: May 14, 1998

[51] Int. Cl.[6] ..... F41H 3/00

[52] U.S. Cl. ..... 428/17; 2/244; 2/900; 428/79; 428/919

[58] Field of Search ..... 2/244, 900; 428/17, 428/79, 919

[56] References Cited

U.S. PATENT DOCUMENTS

| | | | |
|---|---|---|---|
| 4,243,709 | 1/1981 | Morton | 428/919 X |
| 4,865,900 | 9/1989 | Shannon et al. | 428/919 X |
| 5,079,048 | 1/1992 | Anitole | 428/919 X |
| 5,416,928 | 5/1995 | Koenig | 2/227 X |
| 5,660,667 | 8/1997 | Davis | 428/79 X |

*Primary Examiner*—Henry F. Epstein
*Attorney, Agent, or Firm*—Wells, St. John, Roberts, Gregory & Matkin P.S.

[57] ABSTRACT

An adhesive camouflage patch is described in which a flexible base sheet is provided with a perimeter defining an irregular configuration. First and second adhesive surfaces are provided on opposed inside and outside surfaces of the base sheet, covered with removable first and second backing sheets. The second adhesive surface may be of a color selected to be visually non-contrasting with an environmental setting of a surface to be camouflaged. The first backing sheet is removable from the first adhesive surface to enable the first adhesive surface to be applied to the surface to be camouflaged. The second removable backing sheet may be removed to expose the second adhesive surface for adhesive attachment of environmental materials selected from the environmental setting of the surface to be camouflaged.

16 Claims, 3 Drawing Sheets

ADHESIVE CAMOUFLAGE PATCH

TECHNICAL FIELD

The present invention relates to application of camouflage.

BACKGROUND OF THE INVENTION

Extensive research and design has taken place in the area of camouflage, for military, police, hunting, wildlife research and photography. Camouflage clothing has been developed with different forms of patterns and colors for use in specific geographic areas. Some companies even produce camouflage clothing that is seasonally coordinated. However, none have been able to perfectly match every background environment. Thus, while a specific camouflage material might function in general better than no material at all, an alert animal can still quite easily visually detect human presence.

Part of the above problem arises from the fact that a mass-produced garment cannot be made in such a variety of colors that an exact match may be made with every environmental situation. At best, a color tone may be selected that is not at a direct conflict with the coloration in the environment where the camouflage is to be used.

Another problem is that shapes also must be considered for proper camouflage tactics. It is well known that geometric or uniformly curved surfaces do not typically appear in nature. Thus, for example a soldier will wedge twigs and branches under the band of a helmet to hide the smooth helmet contours.

An object of the present invention is to provide an adhesive camouflage patch that will enable a surface to be partially covered with materials from a surrounding environment so the colors and profile of the surface can be made to more visually match the environment.

The above and further objects may be understood from the following description which, taken with the accompanying drawings describe a preferred mode of carrying out the present invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
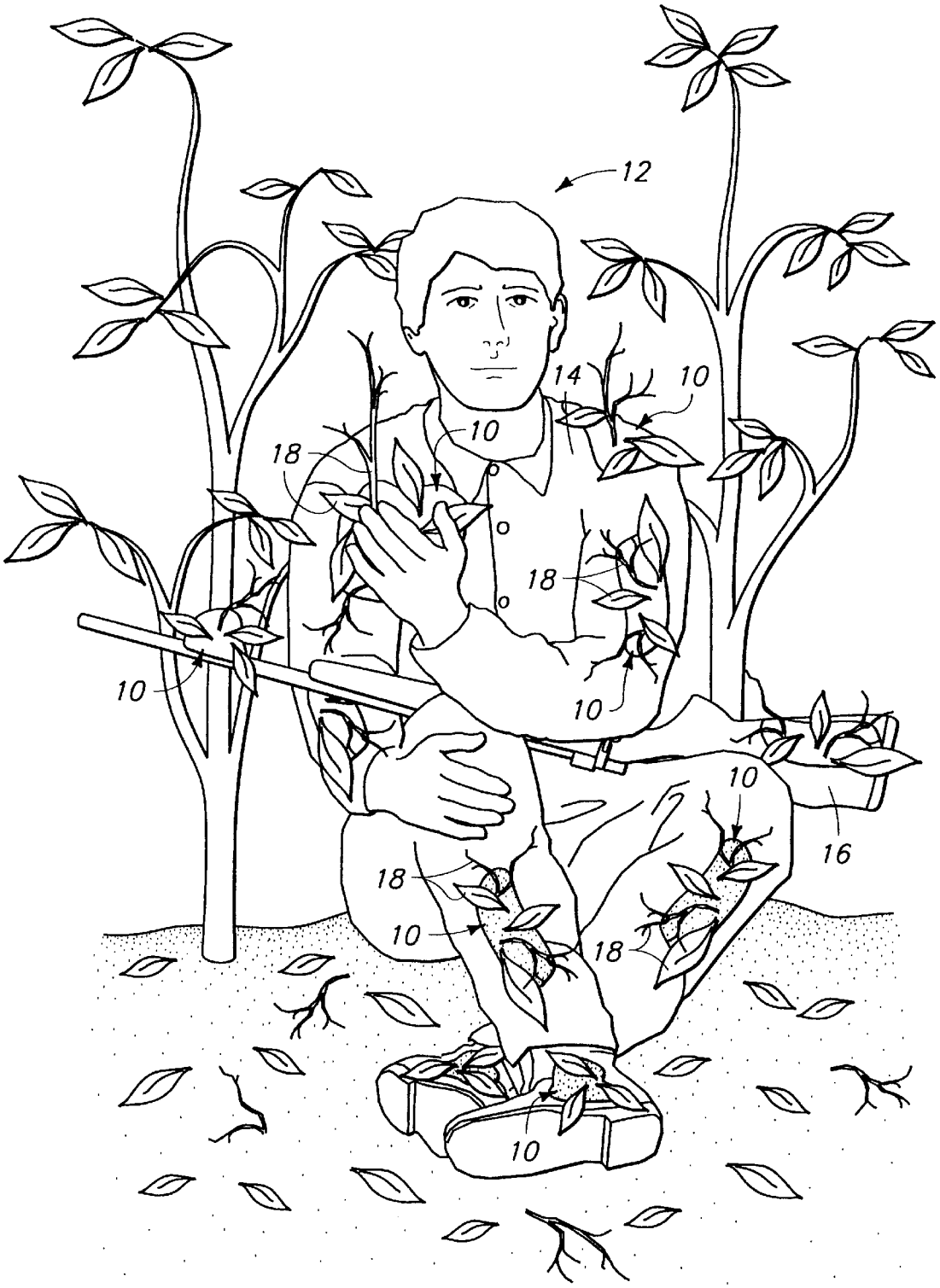
FIG. 1 is an illustrative view of a hunter placing the preferred forms of the present adhesive camouflage patch on his clothing and hunting rifle.

This disclosure of the invention is submitted in furtherance of the constitutional purposes of the U.S. patent Laws "to promote the progress of science and useful arts" (Article 1, Section 8).

The present patch, generally designated in the drawings by reference numeral 10, is intended to be applied to a surface that is intended to be camouflaged. The selected surface may be any firm surface such as the clothing 14 of a hunter 12, rifle 16 (FIG. 1), or another surface to which the patch may be applied. Materials 18, selected from the environmental setting of the surface to be camouflaged, may be attached adhesively to the patches 10.

A preferred form of the present adhesive camouflage patch 10 includes a flexible base sheet 20 having an outside areal surface 22 and an opposed inside areal surface 24. The base 20 sheet may be formed of a number of acceptable materials, most preferably those selected from a group consisting of cloth, paper, leather and plastic. It is preferable that the selected material for the base sheet be biodegradable.

A perimeter 26 of the base sheet 20 joins the surfaces 22, 24 and defines an irregular configuration. That is to say, the perimeter 26 should not include straight lines, uniform curves, or symmetrical shapes. The irregular configuration aids in the camouflage effort by breaking up regular lines or contours on the surface to which the patch 10 is applied. By way of example, note is made of the patch 10 placed on the barrel of the rifle 16 in FIG. 1. The irregular configuration of the patch visually breaks the straight line appearance of the rifle barrel.

A first adhesive surface 28 is provided on the inside surface 24 and a second adhesive surface 30 is similarly provided on the outside surface 22. The nature of the adhesives may vary with the use and nature of surface to which the patches are to be attached. A pressure sensitive adhesive that will not permanently cling to, stain or otherwise damage fabrics is preferred at least for the first adhesive surface 28, for applications in which the patches are to be attached to clothing. It is also desirable that the adhesive be somewhat waterproof. It is also preferred, though not necessary, that the adhesive 28 coat the entire inside surface 24 of the base sheet 20.

The second adhesive surface 30 may be comprised of the same adhesive material as the first surface 28. It is preferred that the second adhesive surface extend over the entire outside surface 22 of the base sheet 20 in order to maximize the surface area to which environmental materials may be adhesively attached.

An example of a double surface adhesive product meeting the above qualifications uses an acrylic adhesive provided on a flexible polyester base and is listed as "tape #415" produced by 3M Bonding Systems Div. in St. Paul, Minn.

Figure 4:
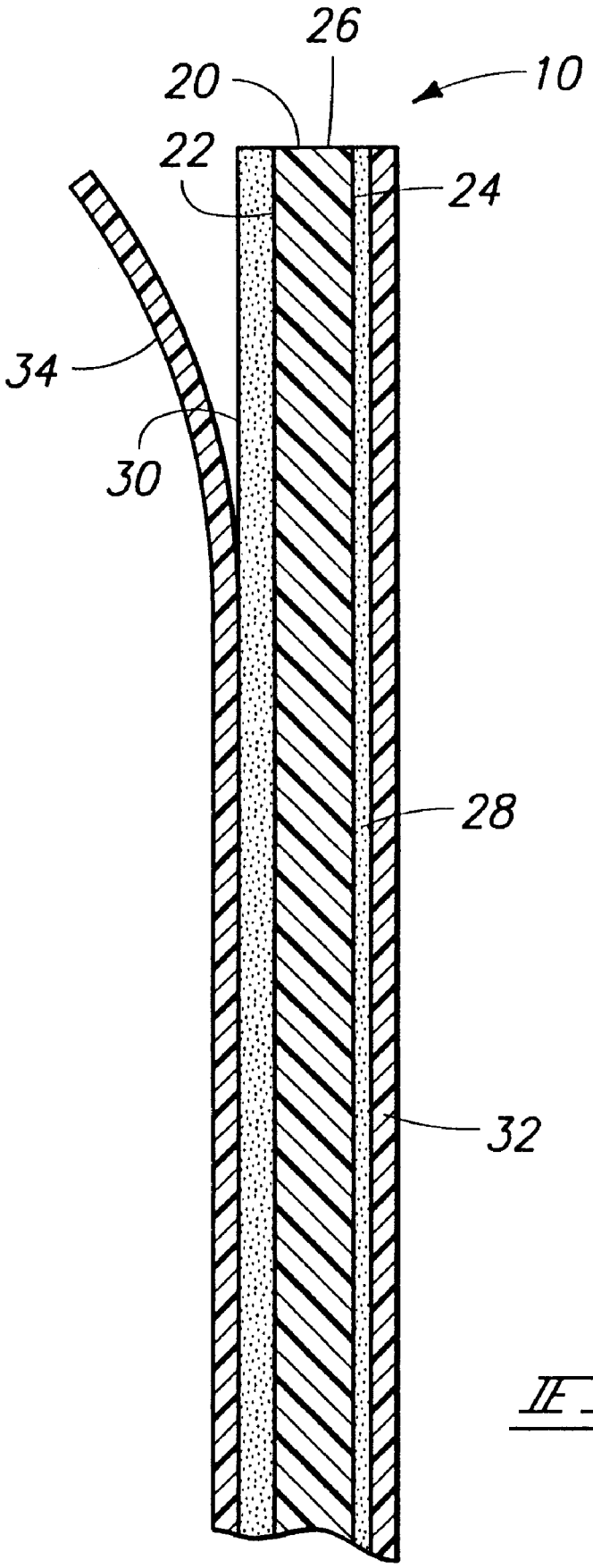
FIG. 4 is an enlarged sectional view taken substantially along line 4—4 in FIG. 2.

The first adhesive surface 28 is preferably thinner than the second adhesive surface 30 (note FIG. 4). More adhesive is therefor placed on the outside surface to still further maximize adhesive contact with environmental materials.

It is preferred that the second adhesive surface 30 be of a color selected to be visually non-contrasting with an environmental setting of a surface to be camouflaged. Coloration of the second adhesive surface 30 may be provided by addition of appropriate pigment to the adhesive. Alternatively, a transparent adhesive may be used and the appearance of adhesive coloration may be achieved by selected coloration applied by conventional means to the outside surface 22 of the base sheet 20. The color will show through the transparent adhesive and achieve the same result.

The present patch may be produced in selections of various colors for the second adhesive surfaces, depending upon the nature of the environment in which the patches are to be used. For example, it may be preferred that a color be selected from earthen or vegetation colors similar to those from the area and season where the patches are used.

It is not necessary that the selected colors perfectly match the environmental colors, only that the second adhesive surface be colored SO there is not a significant color contrast with the selected environment. Precise color matching is not critical since most, if not all, of the colored surface 30 will be covered with actual materials from the environment of the surface to be camouflaged, and the actual materials will inherently include precise matching coloration.

Figure 2:
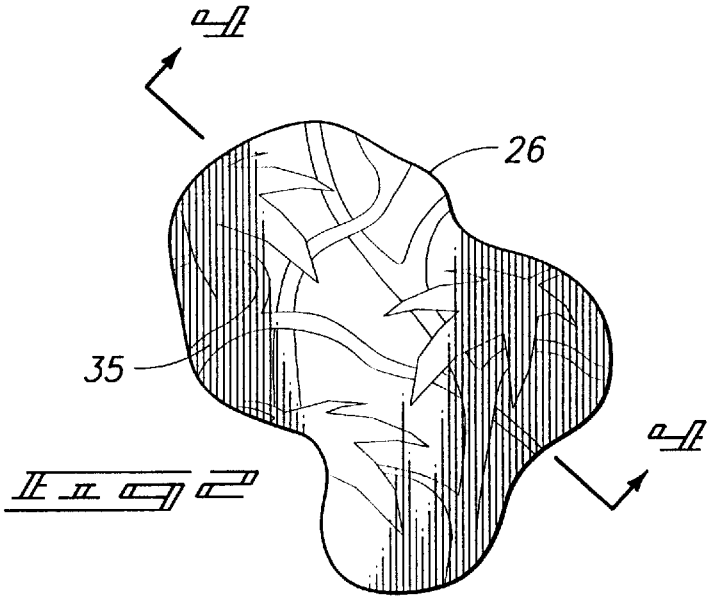
FIG. 2 is a plan view of an exemplary adhesive camouflage patch.

In preferred forms, especially where the patches are provided individually as shown in FIG. 2, the patch will be provided with a first removable backing sheet 32 releasably secured on the first adhesive surface 28. A second backing sheet 34 is also provided, releasably covering the second adhesive surface 30. The backing sheets 32, 34 may be of a conventional material commonly used to protect pressure sensitive adhesives until such time that the adhesive is to be used. The backing sheets may be peeled away, as partially shown in FIG. 4 to expose the adhesive surfaces below.

Either or both backing sheets 32, 33 may be plain, or be provided with a camouflage image 35 (FIG. 2) which may be printed or otherwise conventionally applied to the sheet surface. If both backing sheets are provided with camouflage images, either backing sheet may be removed and the exposed adhesive surface may be attached to the surface to be camouflaged. The image 35 on the remaining backing sheet will then be exposed outwardly and may then be used, if desired, as camouflage. Alternatively, both backing strips may be removed, then re-attached to the exposed adhesive along with materials from the surrounding environment.

Figure 3:
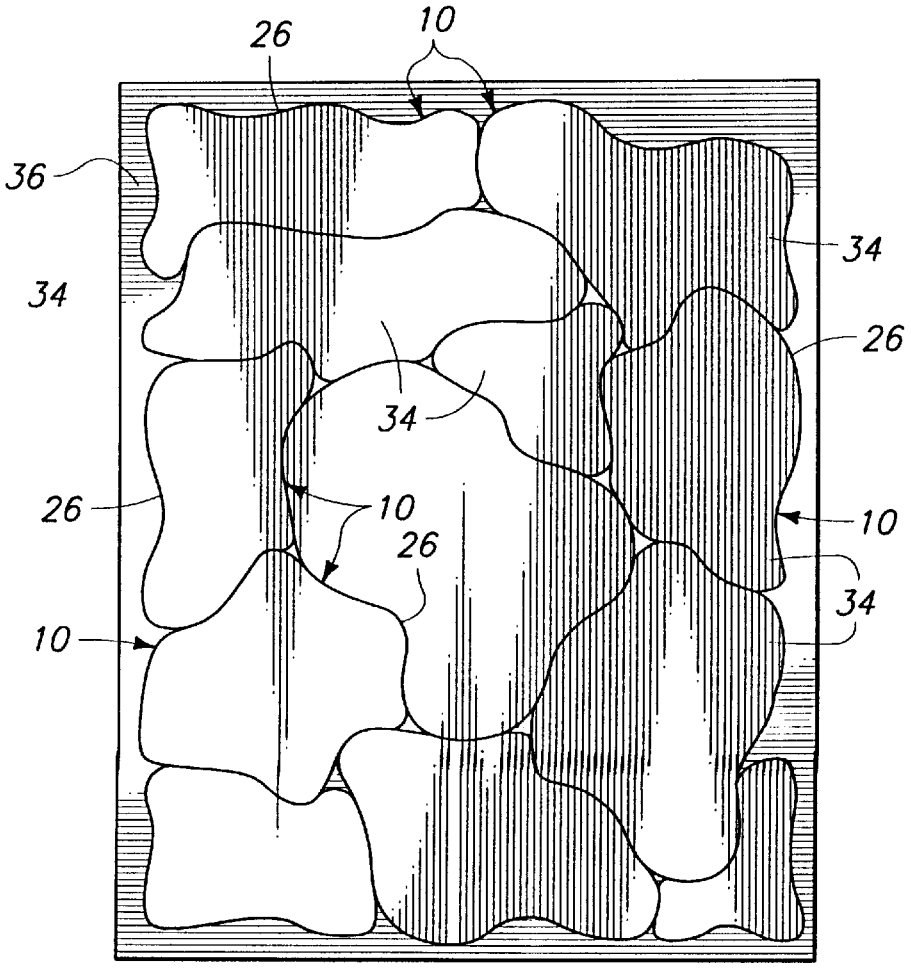
FIG. 3 is a plan view of an embodiment in which several of the patches are provided on a single carrier sheet.

FIG. 3 exemplifies several patches 10 supplied on a common carrier sheet 36. In this form, a number of patches may be die stamped or otherwise partially cut from a sheet, leaving the carrier sheet as a common backing for each of the patches. The individual patches may then be selectively peeled from the carrier sheet 36, automatically exposing one of the adhesive surfaces. Preferably, the first adhesive surfaces are applied to the carrier sheet, so when the patches are removed, the first adhesive surfaces 28 will be exposed and ready for application to a surface to be camouflaged.

Use of the present patch may now be easily understood in view of the above technical description, and with reference to the drawings, particularly FIGS. 1 and 4.

By way of example, a hunter 12 wishing to become less visually prominent may apply a number of the present patches 10 to his clothing 14 and to appurtenance such as the rifle 16. He may do this by one of two methods.

Firstly, the hunter may select successive patches, remove the first backing sheets 32, then apply the patches to the surfaces to be camouflaged. Now he may progressively remove the second backing sheets 34 to expose the colored second adhesive surfaces. Materials are next selected from the immediate environmental area and are attached to the exposed second adhesive surfaces. Care is taken not only to select materials from the immediate area for coloration purposes, but also to place the patches and materials so they will cover or at least visually break any regular lines that would betray his profile.

Materials may be added by hand as shown in FIG. 1, or the hunter may even choose to lie down and roll over the area so materials are randomly collected on the exposed adhesive surfaces.

Secondly, the hunter may choose to first remove the second backing sheets, leaving the first sheets in place until he is ready to place them on his clothing or rifle. He may then select and attach environmental materials to the exposed adhesive surfaces in a suitable manner before removing the first backing sheets and pressing the sheets to selected areas of his clothing.

It is noted from FIG. 1 that the hunter 12 has selected earth materials, twigs, and leaves for application to patches placed near the ground. Thus the patches closest to the ground will take on the appearance of the ground. He has also selected leaves and twigs from adjacent bushes in order to match the contour and coloration of those areas of his body more adjacent to those parts of the bushes above the ground surface. Further, note is made that the hunter has attached patches to his rifle, visually obscuring the stock and barrel. The hunter now blends more with the immediate environment and will be difficult to easily visually detect.

Of course the hunter may elect to use more or fewer of the patches, depending upon the immediate needs. The hunter shown in FIG. 1 is shown with few patches in place merely to clearly show his presence to the viewer. Also the patches are shown clearly behind the attached materials, simply to show the viewer the patch outlines.

In actual use, the hunter may elect to apply as many patches as he wishes. Further, he may place the patches wherever it is deemed most useful to camouflage himself. He may even choose to apply the patches to his skin or hair. The perimeter of the patches will aid in visually obstructing regular shapes, the patch color will visually obstruct any continuous coloration of the hunter's clothing, and the materials attached to the patches will aid to both obstruct the hunters form, and perfectly match the environmental materials.

When the camouflage is no longer needed, the hunter may simply pull the patches off and discard them along with the attached environmental materials. If, as preferred, the patches are comprised of bio-degradable materials, the patches and attached materials may be left in the immediate area to decompose naturally. Alternatively, the patches may be gathered, bagged, and deposited at an appropriate disposal site.

It is pointed out that the present patches may be applied to nearly any surface to which the first adhesive surfaces will adhere. For example, the patches may be used to camouflage a vehicle, much in the manner described above. Further, the size and shape of the patches may vary considerably, but will preferably have an irregular perimeter (which may also vary considerably in shape).

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An adhesive camouflage patch, comprising:

a flexible base sheet having an outside areal surface and an opposed inside areal surface;

a perimeter of the base sheet defining an irregular configuration;

a first adhesive surface on the inside areal surface;

a first removable backing sheet on the first adhesive surface;

a second adhesive surface on the outside areal surface;

the second adhesive surface being of a color selected to be visually non-contrasting with an environmental setting of a surface to be camouflaged;

a second removable backing sheet spanning the second adhesive surface;

whereby the first backing sheet is removable from the first adhesive surface to enable the first adhesive surface to be applied to the surface to be camouflaged, and the second removable backing sheet may be removed to expose the second adhesive surface for adhesive attachment of environmental materials selected from the environmental setting of said surface to be camouflaged.

2. The adhesive camouflage patch of claim 1 in which the flexible base sheet is selected from the group consisting of cloth, paper, leather and plastic.

3. The adhesive camouflage patch of claim 1 in which the second adhesive surface spans the entire outside areal surface of the base sheet.

4. The adhesive camouflage patch of claim 1 in which the first adhesive surface is thinner than the second adhesive surface.

5. The adhesive camouflage patch of claim 1 wherein at least one of the backing sheets includes a camouflage image.

6. The adhesive camouflage patch of claim 1 further comprising a carrier sheet mounting a plurality of the flexible base sheets.

7. An adhesive camouflage patch, comprising:

a flexible base sheet having an outside areal surface and an opposed inside areal surface;

a first adhesive surface on the inside areal surface;

a first removable backing sheet on the first adhesive surface;

a second adhesive surface on the outside areal surface;

the second adhesive surface being of a color selected to be visually non-contrasting with an environmental setting of a surface to be camouflaged;

a second removable backing sheet spanning the second adhesive surface;

whereby the first backing sheet is removable from the first adhesive surface to enable the first adhesive surface to be applied to the surface to be camouflaged, and the second removable backing sheet may be removed to expose the second adhesive surface for adhesive attachment of environmental materials selected from the environmental setting of said surface to be camouflaged.

8. The adhesive camouflage patch of claim 7 further comprising a carrier sheet mounting a plurality of the flexible base sheets.

9. The adhesive camouflage patch of claim 7 in which the flexible base sheet is selected from the group consisting of cloth, paper, and plastic.

10. The adhesive camouflage patch of claim 7 in which the second adhesive surface spans the entire outside areal surface of the base sheet.

11. The adhesive camouflage patch of claim 7 in which the first adhesive surface is thinner than the second adhesive surface.

12. An adhesive camouflage patch, comprising:

a flexible base sheet having an outside areal surface and an opposed inside areal surface;

a perimeter of the base sheet defining an irregular configuration;

a first adhesive surface on the inside areal surface;

a first removable backing sheet on the first adhesive surface;

a second adhesive surface on the outside areal surface;

a second removable backing sheet spanning the second adhesive surface;

whereby the first backing sheet is removable from the first adhesive surface to enable the first adhesive surface to be applied to the surface to be camouflaged, and the second removable backing sheet may be removed to expose the second adhesive surface for adhesive attachment of environmental materials selected from the environmental setting of said surface to be camouflaged.

13. The adhesive camouflage patch of claim 12 further comprising a carrier sheet mounting a plurality of the flexible base sheets.

14. The adhesive camouflage patch of claim 12 in which the flexible base sheet is selected from a group consisting of cloth, paper, and plastic.

15. The adhesive camouflage patch of claim 12 in which the second adhesive surface spans the entire outside areal surface of the base sheet.

16. The adhesive camouflage patch of claim 12 in which the first adhesive surface is thinner than the second adhesive surface.

* * * * *